US005179783A

United States Patent [19]

Melter

[11] Patent Number: 5,179,783

[45] Date of Patent: Jan. 19, 1993

[54] ALL PURPOSE SCISSORS

[75] Inventor: Craig H. Melter, Baraboo, Wis.

[73] Assignee: Fiskars OY AB, Helsinki, Finland

[21] Appl. No.: 815,287

[22] Filed: Dec. 27, 1991

[51] Int. Cl.[5] ..... B26B 13/16

[52] U.S. Cl. ..... 30/262; 30/254; 30/257

[58] Field of Search ..... 30/234, 235, 239, 254, 30/257, 258, 259, 262, 193, 236; 24/590, 591, 597

[56] References Cited

U.S. PATENT DOCUMENTS

| | | | |
|---|---|---|---|
| 154,637 | 9/1874 | Breeden | 30/262 |
| 1,827,149 | 10/1931 | Heimerdinger | 30/257 |
| 2,269,764 | 1/1942 | Gutman | 30/234 |
| 3,775,846 | 12/1973 | Johnson | 30/262 |
| 4,914,820 | 4/1990 | Saito | 30/254 |
| 4,947,553 | 8/1990 | Bendickson | 30/262 |
| 4,980,975 | 1/1991 | Hodson | 30/254 |

*Primary Examiner*—Frank T. Yost
*Assistant Examiner*—Hwei-Siu Payer
*Attorney, Agent, or Firm*—Foley & Lardner

[57] ABSTRACT

An all purpose pair of scissors including a first blade assembly and a second blade assembly, the assemblies being pivotally connected for opening and closing movements, the first blade assembly including a handle having a first catch and a recess in the handle adjacent the first catch, the second blade assembly including a handle having a second catch and a recess in the handle adjacent the second catch, the first and second catches being so located that on closing the first and second blade assemblies the first catch will be seated in the recess in the second handle and the second catch will be seated in the recess in the first handle, the first and second catches interengaging each other on opening the blade assemblies.

5 Claims, 3 Drawing Sheets

ALL PURPOSE SCISSORS

FIELD OF THE INVENTION

The present invention relates to an all purpose type scissors and more particularly to an offset handle arrangement which is actuated by one hand.

BACKGROUND OF THE INVENTION

Household scissors are generally of the type wherein the blades are opened and closed by the thumb and fingers of one hand. However, finger actuated scissors are difficult to actuate by the handicapped and particularly individuals having arthritis. This type of handicap makes it difficult for the individual to use his fingers to manipulate the blades, primarily in opening the scissors. However, it has been determined that a handicapped individual can easily grip the handles to close the scissors.

SUMMARY OF THE PRESENT INVENTION

The scissors according to the present invention generally includes a first blade assembly having a blade mounted in an angularly offset handle and a second blade assembly having a blade also mounted in an angularly offset handle. The blade assemblies are pivotally connected to permit closing of the blades and are biased to an open position. Operation of the scissors thereby requiring only the closing of the handle assemblies.

The scissors are also advantageously provided with an interlock assembly which limits the degree of movement of the handles so that they can be closed with one hand.

According to another aspect of the invention the scissors is provided with a release mechanism which allows for the handle assembly to be quickly and easily disassembled for cleaning, sharpening or any other repair.

Other principal features and advantages of the invention will become apparent to those skilled in the art upon review of the following drawings, the detailed description and the appended claims.

Figures 1, 2, 4:
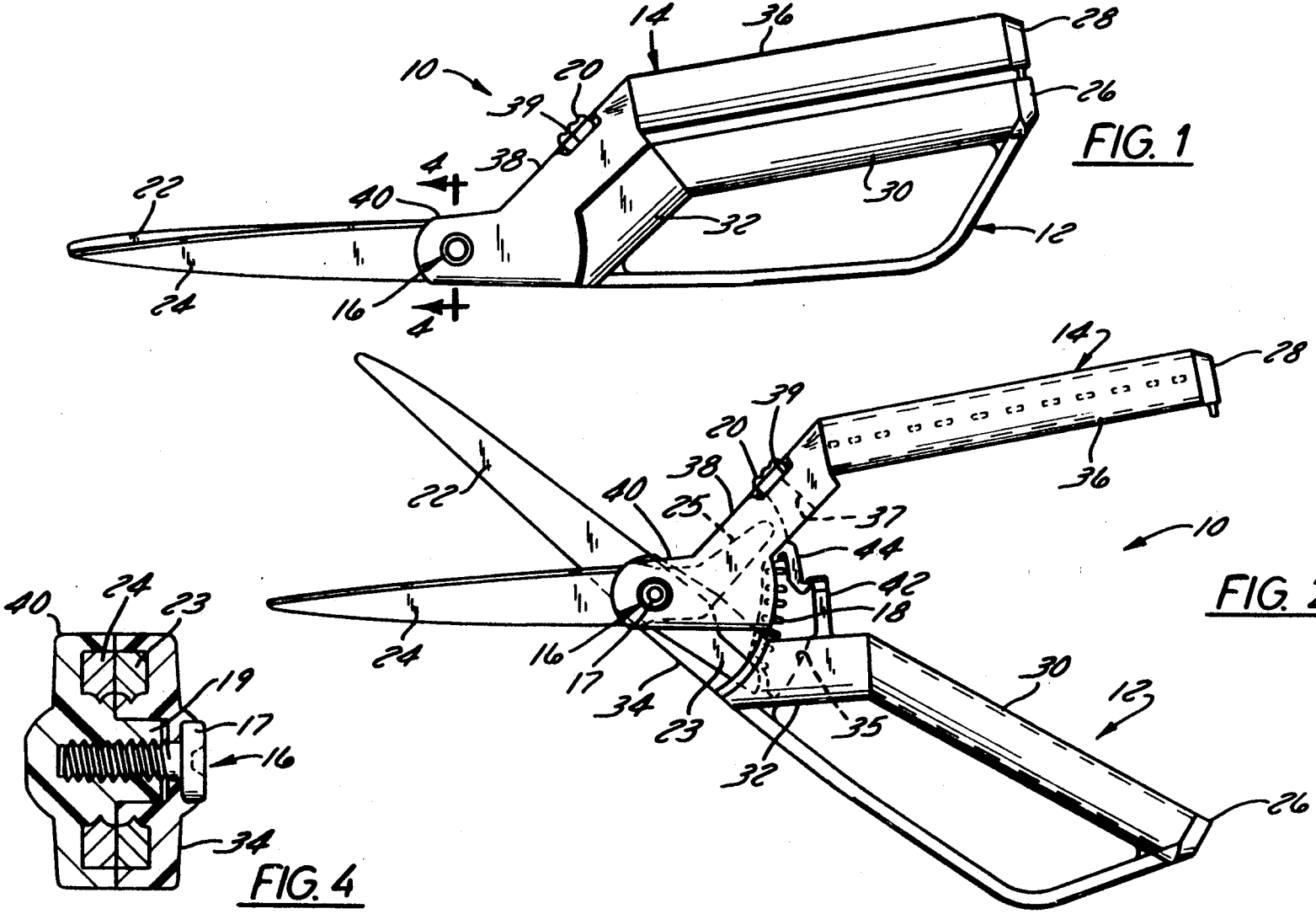
FIG. 1 is a side view of the all purpose scissors according to the invention.
FIG. 2 is a view of the scissors shown in an open position.
FIG. 4 is a view taken on line 4—4 of FIG. 1.
Figures 3, 5:
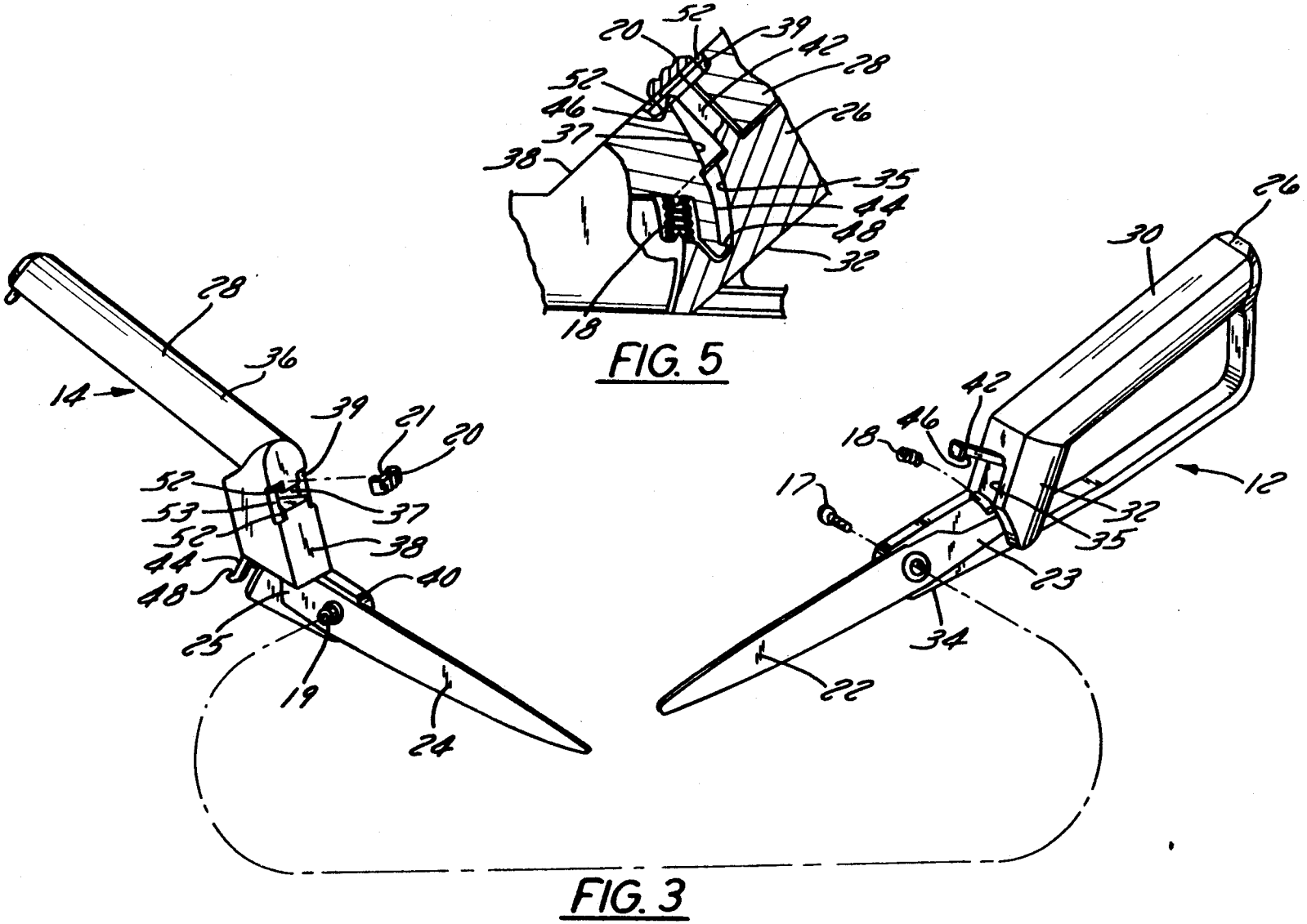
FIG. 3 is an exploded perspective view of each of the handle assemblies.
FIG. 5 is a view partly in section of a portion of the handle assemblies showing the interlocking assembly.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

As shown in the drawing the scissors 10 generally includes a first blade assembly 12 and a second blade assembly 14, the blade assemblies being pivotally connected by means of a bolt and nut assembly 16. The assembly 16 generally includes a bolt 17 and a threaded hub 19. The blade assemblies are biased to an open position by means of a compression spring 18 and are locked in a closed position by means of a button 20.

Figure 9:
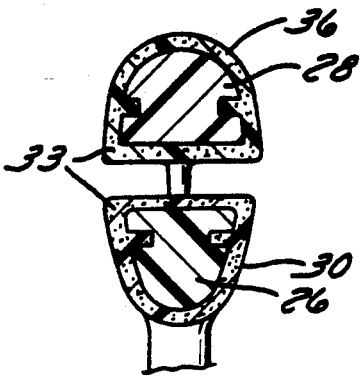
FIG. 9 is a view taken on line 9—9 of FIG. 6.

The first blade assembly 12 generally includes a handle 26 and a blade 22. The second blade assembly also includes a handle 28 and a blade 24. The first handle 26 includes a handle portion 30, an angularly offset section 32 and a blade mounting section 34. The second handle 28 also includes a handle portion 36, an angularly offset portion 38, and a blade mounting section 40. The threaded hub 19 is molded on the side of section 40. The blade 22 includes a tang 23 which forms an extension of the blade 22. The blade 24 includes a tang 25 which is offset at an angle of approximately 140° from the blade. The tangs 23 and 25 are molded into recesses provided in the blade mounting sections 34 and 40 as is generally known in the art. The handles 26 and 28 are molded from a 30% fiberglass reinforced polypropylene material or other similar material and covered with a cushion material 33 such as Crayton TM as shown in FIG. 9.

Means are provided for limiting the opening motion of the second blade assembly 14 with respect to the first blade assembly 12. Such means is in the form of a fish hook type catch arrangement provided in the offset sections 32 and 38 of handles 26 and 28, respectively. In this regard each of the handles 26 and 28 includes a catch in the form of fish hooks 42 and 44, respectively. Each fish hook includes a lip 46 and 48, respectively, as shown in the drawing. The handle 26 includes a recess 35 and the handle 28 includes a recess 37. When the second blade assembly 14 is in the open position, the lip 46 on the fish hook 42 will engage the lip 48 on the fish hook 44 as shown in FIG. 2, thus limiting the opening motion of the blade assemblies.

Means are provided for locking the first and second blade assemblies 12 and 14 in a closed position. Such means is in the form of the button 20 which includes a T-shaped slot 21 mounted in a slot 39 in the angular offset section 38 of the second handle assembly 14. The T-shaped slot 21 in button 20 is mounted for sliding movement on T-shaped tabs 52, formed in the slot 39 in offset section 38. On closing the handles the fish hook 42 will move through recess 37 in the offset section 38 and out through opening 53 between tabs 52. The fish hook 44 will move into a recess 35 in offset section 32. The button 20 is then moved downward to engage the sides of lip 46 on the top of hook 42.

Figure 6:
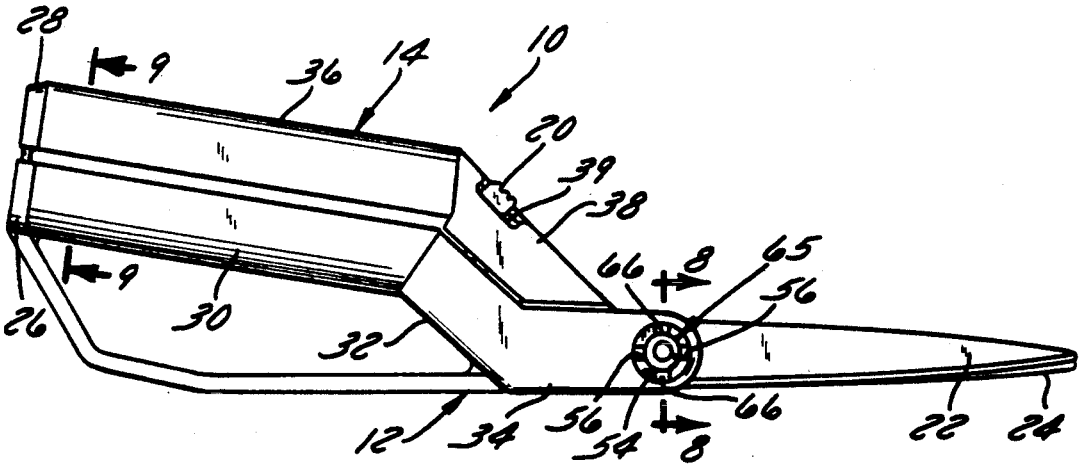
FIG. 6 is a side view of the scissors pivotally connected by a release mechanism.
Figure 7:
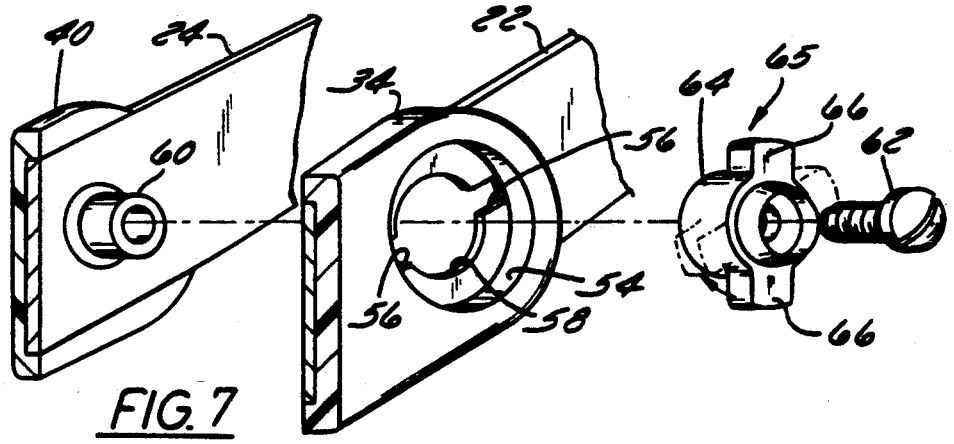
FIG. 7 is an exploded view of the release mechanism.
Figure 8:
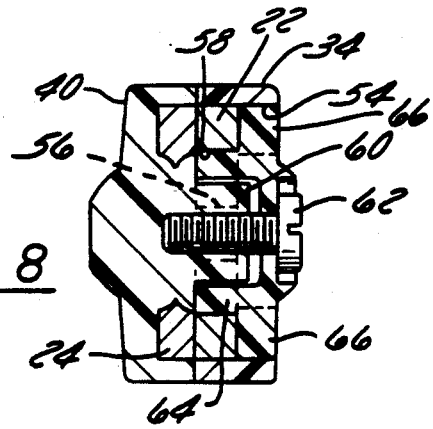
FIG. 8 is a view taken on line 8—8 of FIG. 6.

In the embodiment of the invention shown in FIGS. 6, 7 and 8, an alternate form of the invention is shown wherein means are provided for quickly and easily separating the handle assemblies. Such means is in the form of a release latch or knob 65. Referring to the drawings, the blade mounting section 34 of handle 26 is provided with an annular recess 54. A slot 56 having a circular opening 58 in the center is provided in blade 22. The slot 56 is parallel to the longitudinal axis of blade 22. A cylindrical hub 60 is provided on the blade mounting section 40 which extends through blade 24 and is axially aligned with the opening 58. The release knob 64 has an outer diameter smaller than opening 58 and includes a pair of tabs or extensions 66. The knob 64 is secured to the hub 60 by a bolt 62 with the extensions 66 aligned transversely to the longitudinal axis of blade 24. The handle assembly 12 is removed from the handle assembly 14 by rotating the handle assembly 12 to align the slot 56 with the tabs or extensions 66. It should be noted that the fish hook 44 must be pushed forward to release lip 48 from lip 46 in order to rotate the handle assembly 12 far enough to align slots 56 with knob 65.

Thus, it should be apparent that there has been provided in accordance with the present invention an all purpose scissors that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An all purpose pair of scissors comprising:

a first blade assembly including a first handle and a first blade having a tang molded in the first handle, a second blade assembly including a second handle and a second blade having a tang angularly offset from the second blade and molded in the second handle, means pivotally connecting said blade assemblies, said first handle including a first catch and a recess in said first handle adjacent said first catch, said second handle including a second catch and a recess in said second handle adjacent said second catch, said first and second handles being so located that on closing said scissors the first catch will be seated in the recess in the second handle and the second catch will be seated in the recess in the first handle, said first catch and said second catch interengaging each other on opening said scissors to limit the distance between the handles whereby the handles can be grasped by one hand when the scissors are open.

2. The scissors according to claim 1 including means for biasing the scissors to an open position.

3. The scissors according to claim 1 wherein said second handle includes means for engaging said first catch when said scissors are closed to lock the scissors in the closed position.

4. The scissors according to claim 1 wherein said pivot means includes a release latch for separating said first and second blade assemblies for cleaning, repair or replacement.

5. The scissors according to claim 1 wherein each of said first and second handles includes a cushion molded on each of said handles.

* * * * *